US006435802B1

(12) United States Patent
Schreiber et al.

(10) Patent No.: US 6,435,802 B1
(45) Date of Patent: Aug. 20, 2002

(54) MULTI COMPARTMENT RESIDENTIAL MANUAL SIDE LOADING COLLECTION VEHICLE

(75) Inventors: Lynn Donald Schreiber, Medicine Hat; Harvey James Aasman, Redcliff; Simon Huang, Medicine Hat, all of (CA)

(73) Assignee: Wittke Inc., Medicine Hat (CA)

( * ) Notice: Subject to any disclaimer, the term of this patent is extended or adjusted under 35 U.S.C. 154(b) by 0 days.

(21) Appl. No.: 09/475,181

(22) Filed: Dec. 30, 1999

(51) Int. Cl.[7] ..... B65F 3/02

(52) U.S. Cl. ..... 414/517; 414/525.6; 414/492; 414/406

(58) Field of Search ..... 414/517, 518, 414/511, 512, 406, 407, 408, 409, 525.6, 525.1, 525.2, 492; 298/23 S, 23 MD; 100/218

(56) References Cited

U.S. PATENT DOCUMENTS 3,757,969 A * 9/1973 Smith ..... 414/525.6 X
4,096,956 A * 6/1978 Graskin ..... 414/525.6 X
4,552,500 A * 11/1985 Ghibaudo et al. ..... 414/492 X
4,557,658 A * 12/1985 Lutz ..... 414/517
5,823,728 A * 10/1998 Veldman et al. ..... 414/525.6 X
5,931,628 A * 8/1999 Christenson ..... 414/406 X
6,012,892 A * 1/2000 Stragier ..... 414/525.6 X

FOREIGN PATENT DOCUMENTS

DE 004024568 * 2/1992 ..... 414/406
WO WO 094005568 * 3/1994 ..... 414/408

* cited by examiner

*Primary Examiner*—Frank E. Werner

(57) ABSTRACT

A manual side loading refuse vehicle has a plurality of refuse storage compartments and an equal number of hopper compartments divided by means of a slide separator attached to a pack blade which moves together with said pack blade to compact the refuse. The wall dividing the refuse storage compartments is vertically and rearwardly tapered. A rear hinged door is provided for each refuse storage compartment. The door is unlatched and opened by means of a directional movement of a hydraulic cylinder and closes and latches by means of movement of the hydraulic cylinder in the opposite direction.

8 Claims, 7 Drawing Sheets

MULTI COMPARTMENT RESIDENTIAL MANUAL SIDE LOADING COLLECTION VEHICLE

BACKGROUND OF THE INVENTION

This invention relates to refuse collection vehicles. More particularly, this invention relates to refuse collection vehicles which have been segmented into compartments for collecting and keeping separate different categories of refuse including recyclables.

More particularly, the present invention relates to a manual side loader type of refuse collection vehicle.

The disposal of refuse in residential and populated areas is increasingly becoming complicated and challenging as governments and municipalities variously encourage, direct and mandate that recyclable refuse items be separated and segregated from ordinary refuse and that this distinction be necessarily preserved during the collection and disposal steps. Recyclable refuse is rapidly becoming a standard and discrete component of refuse which must be separately collected by refuse operators and their vehicles. Typically, recyclable refuse consists generally of bottles, glass, cans and plastic which are segregated in the household from ordinary refuse and typically placed at curbside in blue boxes or the like.

The collection of refuse, of which the recyclable component now forms a discrete part, requires that the refuse components remain segregated during the collection sequence and equally means that they be separately disposed of as well. One way of achieving this purpose is to designate and use different vehicles for designated refuse. For example, two refuse vehicles would be used to comprehensively collect the refuse previously collected by one vehicle. This may, depending on circumstances, be both inefficient and costly to all concerned with the orderly removal of refuse.

This state of affairs suggests that consideration be given to the use and modification of a single vehicle to enable it to collect, by way of example, two types of refuse comprising recyclables and ordinary refuse which are the components identified herein by way of example.

Generally, refuse is collected at curbside and manually placed by the operator into the hopper section of a side loading type of refuse vehicle. The hopper section includes a hydraulically operated pack blade which compacts and moves the refuse from the hopper section to the rear storage section of the vehicle. Typically, the pack blade is used to push the refuse beneath and underneath a breaker bar at the rear end of the hopper. This horizontal movement of the pack blade in turn also moves the refuse rearwardly and upwardly over the incline or ramp normally associated with a side loader type of vehicle which has a drop frame deck in order to locate the hopper closer to the ground in order to permit the operator to more easily access the hopper with the refuse. Thus, refuse is moved into the rear collection section of the refuse vehicle where the refuse becomes compacted and temporarily stored for delivery to a refuse collection station. Once the vehicle is full, the refuse is transported in the vehicle and emptied by means of typically inclining or raising the vehicle body to cause the refuse to slide out of the rear of the vehicle through a door which has been opened for this purpose.

Thus, in proposing solutions for adapting a refuse vehicle to enable it to collect both types of refuse at the same time, consideration must first be had for the type and configuration of the vehicle being used for refuse collection. For example, for front and rear loading vehicles, different considerations would apply which need not be discussed herein. In the present case, a standard manual side loading vehicle is the subject of the inventive improvements herein made and described. The term manual refers to the fact that the operator of the vehicle manually loads the hopper with the refuse which has been placed at curbside for pick up.

It has been known to create two hopper and refuse storage compartments for a refuse collection vehicle so that both types of refuse may be selectively collected in the designated compartment.

This type of solution also requires that the hopper section of the vehicle be segmented or divided for purposes of selectively receiving a particular type of refuse. One way of achieving this is to segment the pack blade and in effect create two pack blades operating to either side of a fixed portion within the hopper. This solution requires that each pack blade be selectively operated at different times in order to compact the different kinds of refuse. A disadvantage of this method includes the requirement for mechanisms and controls for two pack blades.

Alternatively, the hopper section may be divided by means of a divider attached to the pack blade which moves with it during the compacting sequence. In this configuration, the separated refuse in the hopper sections is compacted simultaneously by means of a single motion of the pack blade. In yet other solutions, the divider is not attached to the pack blade but is fitted and secured within the hopper section by means of securement therein. This, in turn, requires that the pack blade be adapted by means of a cut out to permit the pack blade to travel over the fixed divider while compacting the refuse. This latter method has the disadvantage of weakening the compactor blade. The solution of attaching a moving divider to the pack blade has the disadvantage of having, in a drop frame deck type vehicle application, having the leading edge of the divider come in contact with the ramp or incline associated with the drop frame deck. One way of solving this is to make a collapsible divider which collapses and travels upwardly over the incline or ramp maintaining the separation between refuse. This solution has the disadvantage of requiring a complicated collapsible divider machined and assembled from several parts which is prone to malfunction.

It has also been observed that while the standard, single compartment refuse vehicles, may be readily emptied at the collection station, dividing the body of the vehicle into two compartments in fact binds the compacted refuse within the segmented compartments and makes it difficult for emptying of same.

As well, the segmentation into compartments of refuse collection vehicles also requires that the different types of refuse be emptied at different stations. As such, the use of a single rear door in combination with interior pivoting doors which divide and configure the interior of the refuse body requires that a preset travel path is required for the vehicle on the way to the collection station. This is because the refuse from one side compartment of the vehicle needs to be first emptied at a first location so as to permit the movement of the interior doors to the other side to permit the other compartment side of the vehicle to be emptied at a second location. To the extent that each segmented compartment has its own rear door, difficulties have been encountered in latching and locking the doors as well as opening the doors for the emptying sequence.

SUMMARY OF THE INVENTION

Accordingly, it is an object of the present invention to provide a multi compartment manual side loading refuse vehicle which is useful for segregating, storing, transporting and emptying different categories of refuse including recyclables and which vehicle may be easily converted from a single refuse compartment vehicle.

In the embodiment of the manual side loading refuse vehicle of the present invention a plurality of refuse storage compartments is achieved by dividing the refuse storage area of the vehicle by means of a vertical wall to divide the refuse storage area into side by side compartments. The vertical wall is outwardly and rearwardly tapered on each side to facilitate the egress of refuse when unloading the vehicle. The hopper section of the vehicle includes a pack blade and a slide separator attached to the face of the pack blade which divides the hopper section into a number of compartments equal to the number of compartments into which the refuse storage area has been divided. Each hopper compartment communicates with a refuse storage compartment by means of a passage. The slide separator moves together with the pack blade through a slot in the floor of the hopper section so as to maintain a physical separation between the compartments in the hopper while the pack blade is compacting the refuse and moving such refuse to the refuse storage compartment by means of pushing it through the passage.

Each refuse storage compartment is provided with a rear door which is hinged at the top by means of a slot flange pin hinge assembly which, in combination and co-operation with a hook flange unlatches and opens the rear door in response to a retraction of a hydraulic cylinder. The door is closed and latched by means of an extension of the hydraulic cylinder.

These and other objects, features and advantages of the present invention will become apparent upon reading the following specification in conjunction with the accompanying drawing figures.

BRIEF DESCRIPTION OF THE DRAWING FIGURES

DETAILED DESCRIPTION

Figure 1:
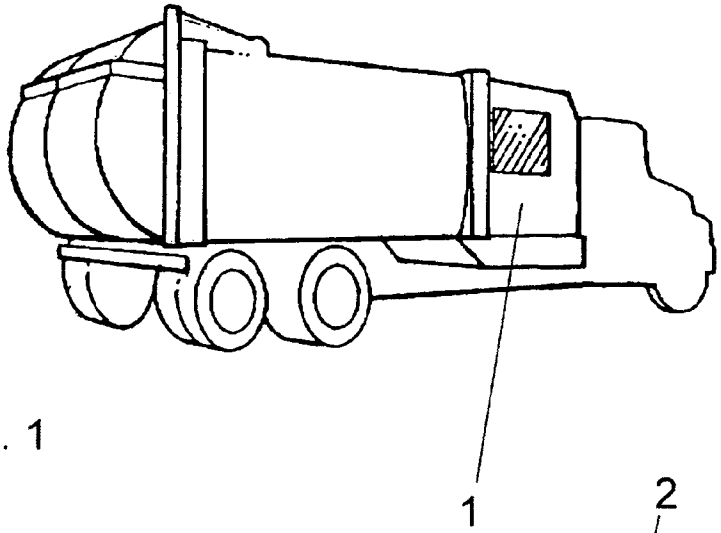
FIG. 1 is a perspective presentation of a multi compartment manual side loading refuse vehicle according to one embodiment of the present invention.
Figure 2:
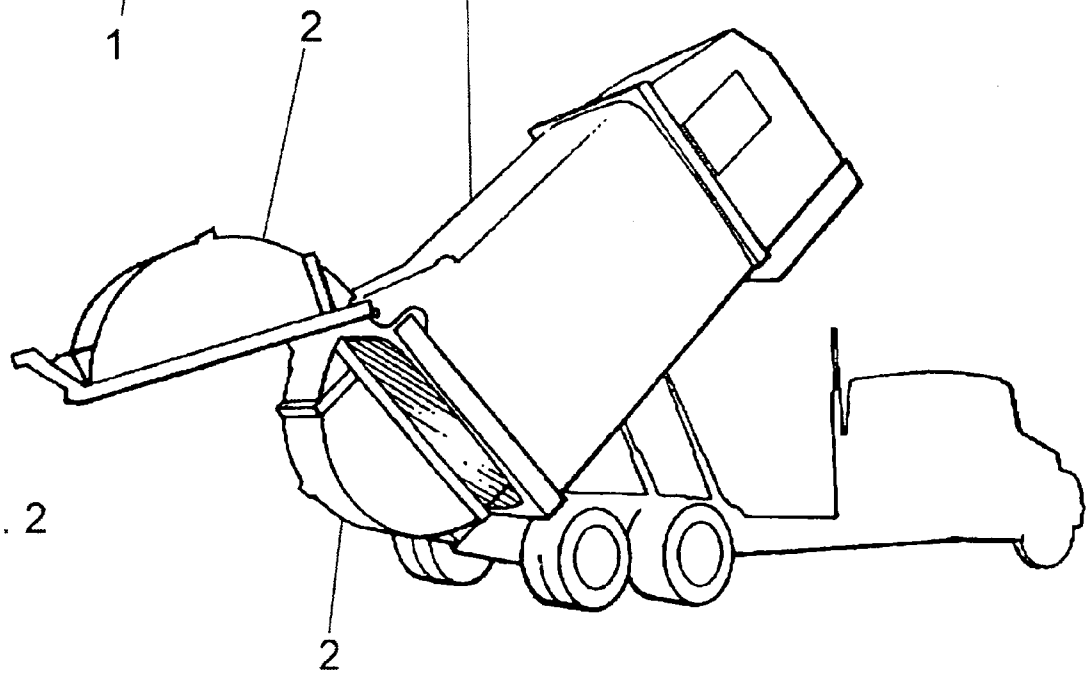
FIG. 2 is a perspective presentation of a multi compartment manual side loading refuse vehicle shown tilted for emptying with one of two rear doors open.

Referring now to the drawings wherein like reference numerals represent like parts or areas, FIGS. 1 and 2 generally illustrate the main external features of a the multi compartment manual side loading vehicle. In particular, the hopper section into which refuse is manually placed is shown to be located at the forward end of the vehicle and behind access door (1). In the embodiment shown in FIG. 2, two refuse storage compartments are illustrated, each having a rear door. In the Figure, the truck body (3) is shown tilted, in the refuse emptying configuration, with one of the two rear doors (2) opened as will be described hereinafter.

Figure 3:
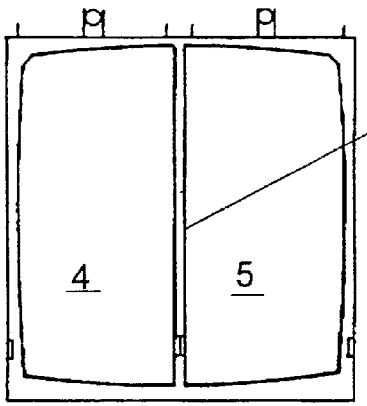
FIG. 3 is a vertical cross-sectional schematic view of the storage sections of a multi compartment manual side loading vehicle.
Figure 4:
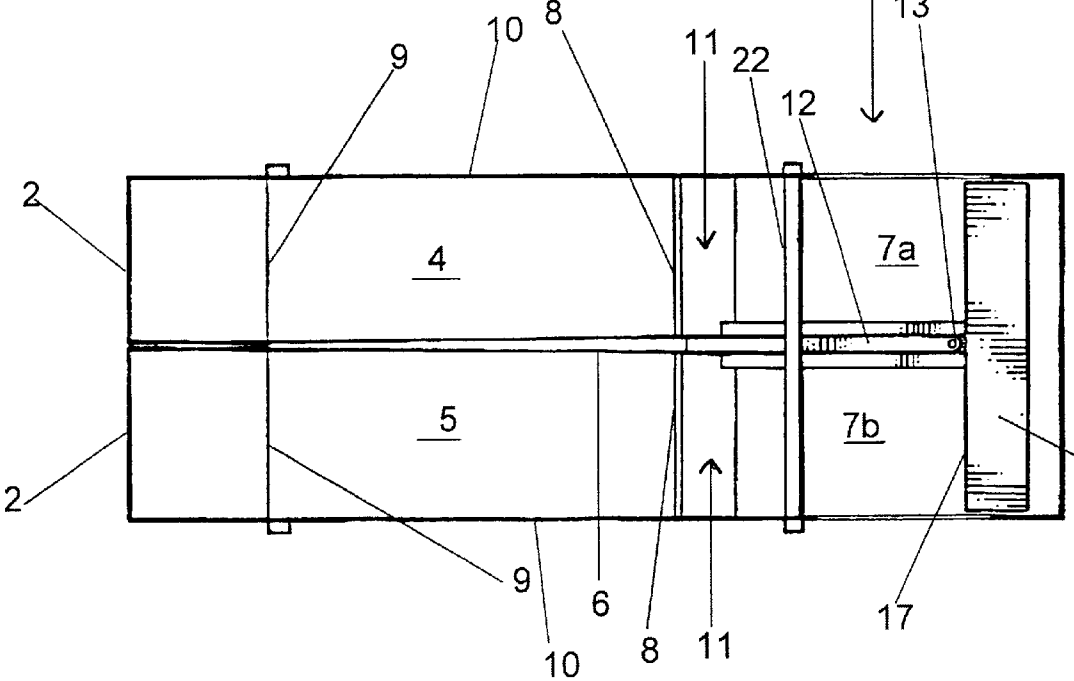
FIG. 4 is a horizontal cross-sectional schematic view of a multi compartment manual side loading vehicle.

Two side by side refuse storage compartments of a typical manual side loader refuse vehicle are shown in FIGS. 3 and 4. In practice, a standard refuse storage compartment is vertically and longitudinally divided into side by side refuse storage compartments (4) and (5) by means of a vertical dividing wall (6). Each refuse storage compartment (4) and (5) is thus bounded at the top and bottom by the roof and floor of the vehicle body, and at the ends by means of the door (2) at the rear and forward wall (22) at the front.

Referring to FIG. 4, the side by side refuse storage compartments (4) and (5) are once again illustrated showing as well the divided portions (7*a* and 7*b*) of hopper section (7) into which the refuse is placed. While the means of installation of a vertical divider wall such as (6) to longitudinally divide the refuse storage section into two compartments would be apparent to those skilled in the art, it is to be noted that the vertical dividing wall of the present invention is tapered. A longitudinally taper is provided, such that the width (8) of the compartment at the forward end of the vehicle adjacent the hopper is narrower than the width (9) adjacent the door. Thus, a tapered refuse compartment is provided without the need to vary or re-design the exterior walls (10) of the vehicle body. It has been found that a 2 inch taper over a length of approximately 120 inches is preferable and greatly facilitates the egress of the refuse by means of tilting as shown in FIG. 2.

Referring further to FIG. 4, the hopper section (7) is shown to be divided into two compartments 7*a* and 7*b* by means of a slide separator (12). The vertical slide separator is shown in greater detail in FIG. 6 and is pivotally attached to the front face (17) of the pack blade (16) by any suitable means as, for example, a pin (13) connecting interlocking fixed flange connecting elements on each of the pack blade and slide separator. In the embodiment shown, the hopper section is shown to have been divided into two sections (7*a* and 7*b*) each communicating by means of a refuse passage (11) to the rear refuse storage compartments (4) and (5).

Figure 5:
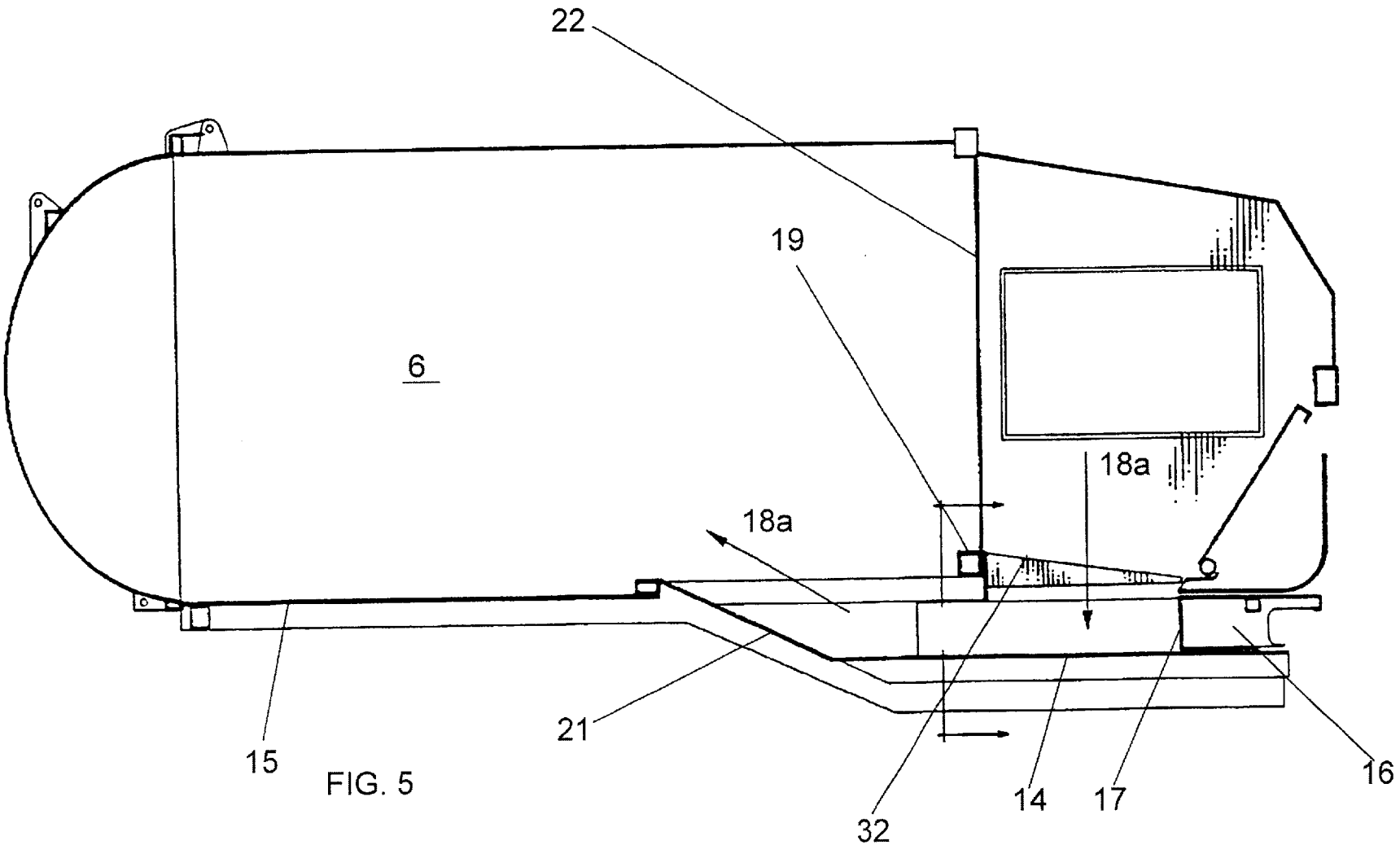
FIG. 5 is a longitudinal cross-sectional schematic view of a multi compartment manual side loading vehicle.
Figure 6:
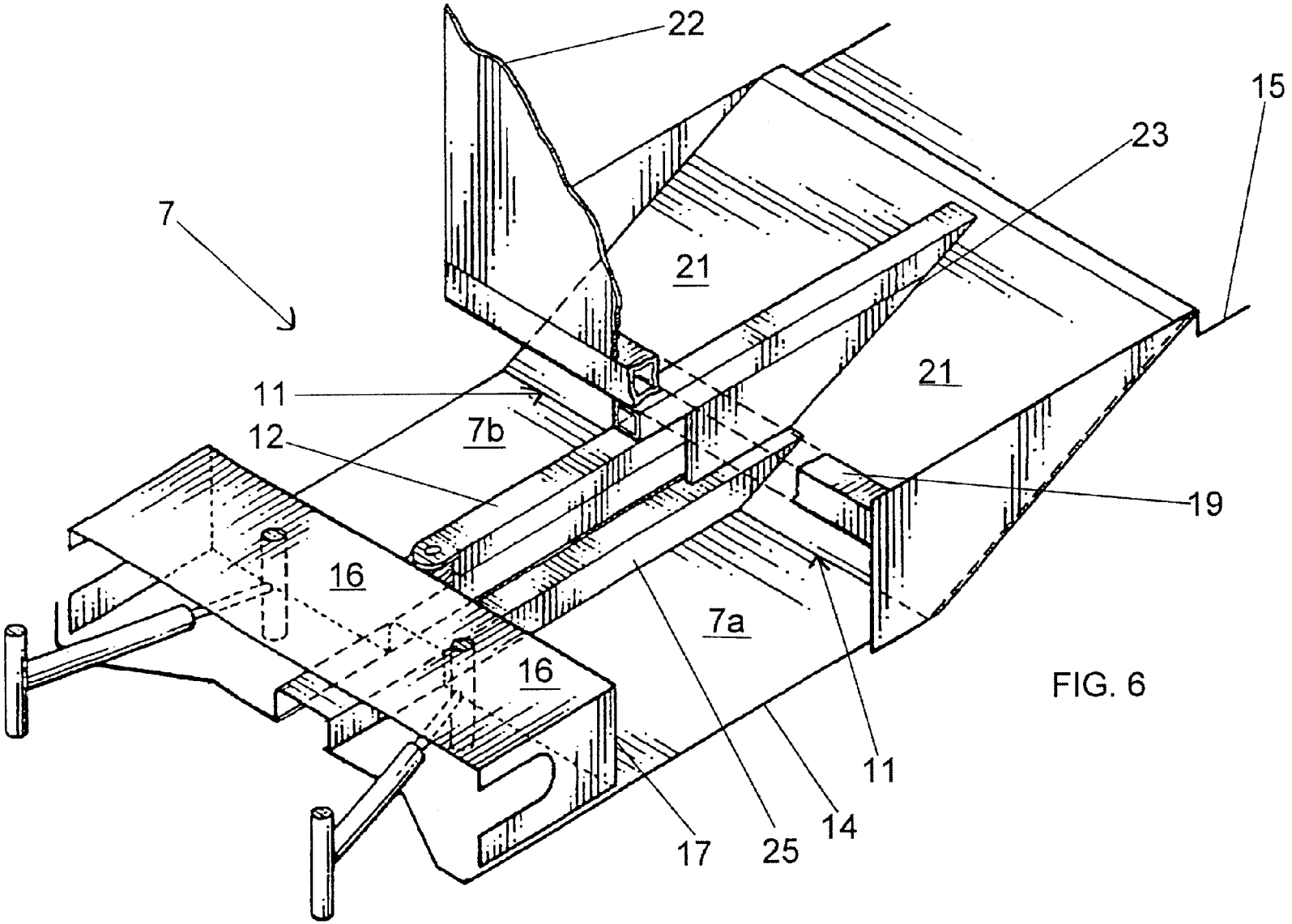
FIG. 6 is a perspective view, partly in cross-section, of a divided hopper section showing the packer blade and slide separator assemblies.

Referring to FIGS. 5 and 6, the drop frame deck feature associated with a manual side loader vehicle is shown in cross-section wherein the floor (14) of the hopper section (7) is lowered beneath the normal floor height (15) of the vehicle. This is accomplished by adapting the frame of vehicle by lowering a portion thereof resulting in what is called a drop frame deck. The function of the drop frame deck is to permit the operator to more easily load the refuse into the hopper since it is now lower to the ground. The lowering of the floor hopper section nonetheless necessitates that refuse in the hopper be eventually moved upward over an incline ramp (21) to reach the normal height of the floor of the vehicle and into the refuse storage compartment.

The general path of travel for the refuse is shown in FIG. 5 by means of arrows 18*a* and 18*b* with reference to the other features of the vehicle. The refuse in the hopper is moved by means of the pack blade (16) which has a horizontal front face (17). The pack blade (16) compacts the refuse and moves it up the incline ramp (21) and underneath the breaker bar (19) and into refuse compartment (4) or (5). It is to be noted in FIG. 6 that end wall (22) defines one end of the refuse storage compartment and that the vertical dividing wall (6) is not shown but would normally abut and be connected to wall (22) to create the physical separation between the compartments.

Additionally, a stationary separator or divider (32) may be installed immediately above the moving slide separator (12), and in vertical alignment therewith, to better define and physically separate the hopper section into two compartments.

Figure 7:
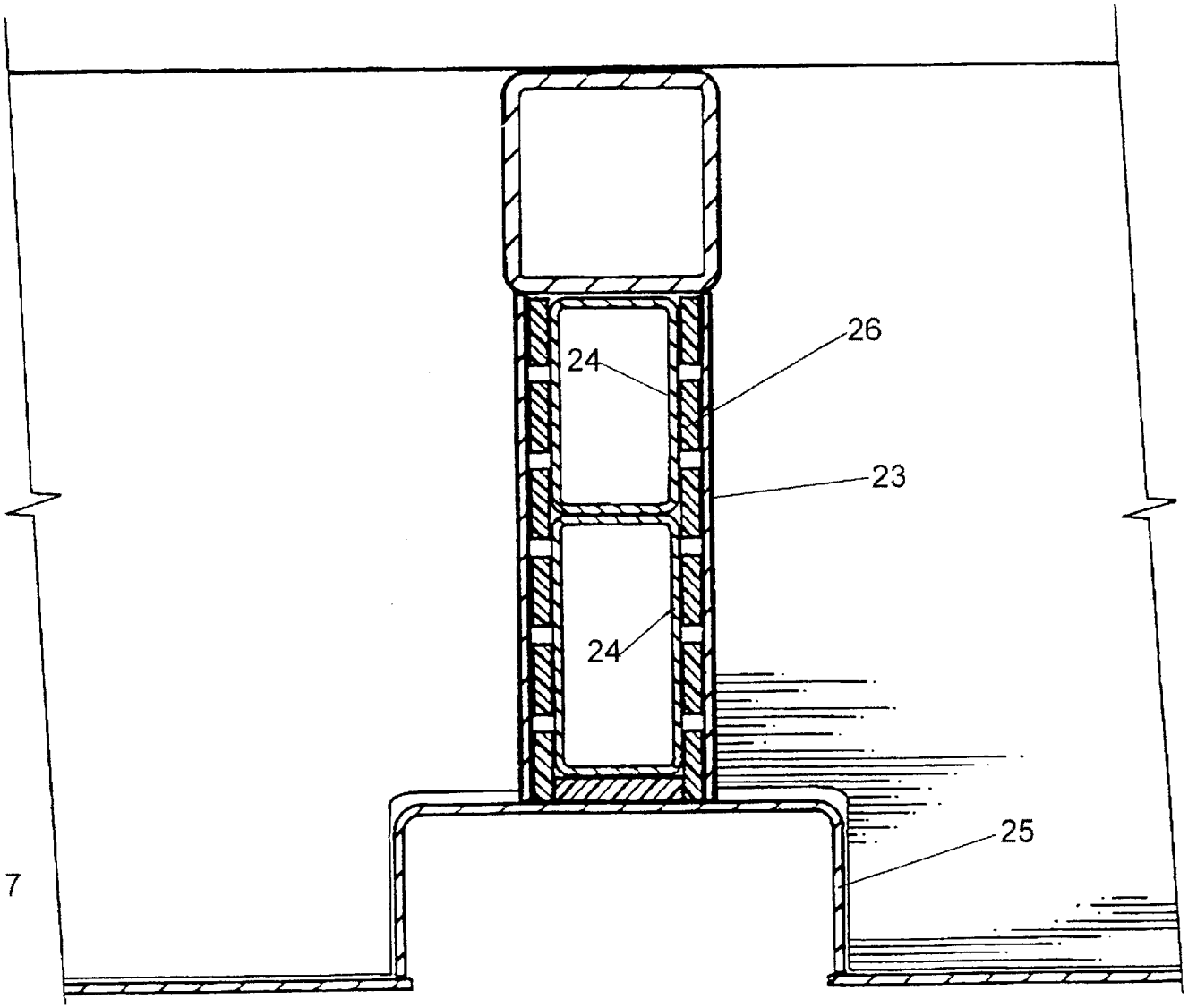
FIG. 7 is a cross-sectional view, inter alia, of the slide separator taken at section AA of FIG. 5.

The detail and particulars of how the hopper section is divided into the two compartments 7*a* and 7*b* by means of a moving slide separator (12) attached to the front of the pack blade is shown in FIG. 6. The drop frame deck feature of a manual side loader refuse vehicle, necessitating the incline ramp (21), requires that the floor of the incline ramp (21) be provided with a vertical slot or cutout (23) to permit the forward end of the slide separator to pass through it and exit underneath the vehicle body. This detail is shown in FIG. 7.

In the particular embodiment, the slide separator is constructed of two rectangular tubes (24), which have been welded together. In the embodiment shown the bottom of the slide separator is in contact with a raised rectangular section (25) on the floor of the hopper section which is also a feature of the drop frame deck. To facilitate the movement of the slide separator, a strip of Teflon® material (26) is attached to the floor of the hopper section and sides of the cutout (23) to minimize the friction at all the relevant points where the exterior metal surfaces of the slide separator are in sliding contact with stationary metal elements of the vehicle frame.

Referring generally to FIGS. 5 and 6, two different types of refuse are selectively placed in each of the hopper sections 7*a* and 7*b*. By means of the pack blade (16) the refuse is moved rearwardly underneath the breaker bar (1*a*) and upwardly, by means of the incline ramp (21), into the refuse storage compartment (4 or 5).

Figure 8:
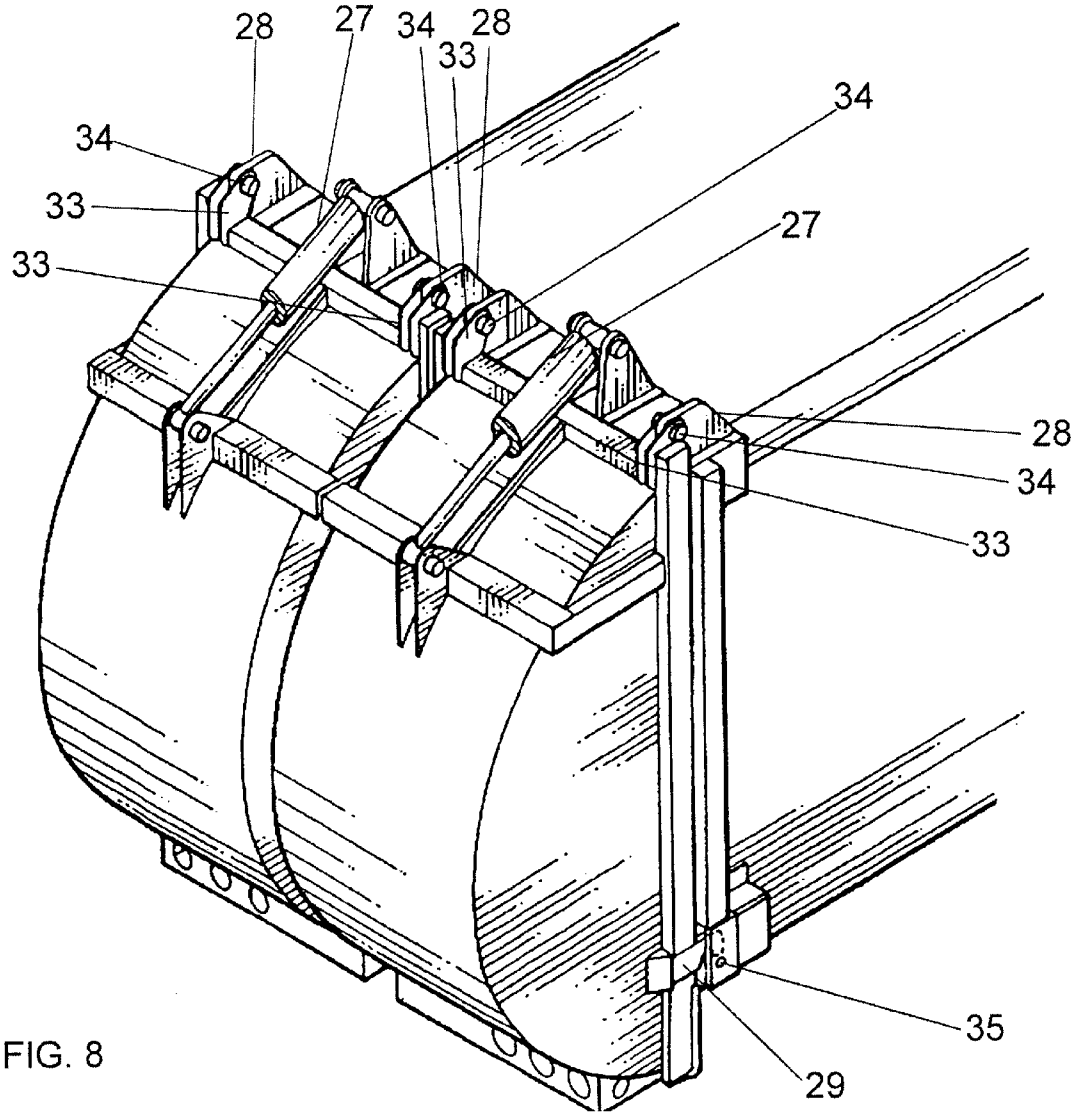
FIG. 8 is a perspective view of the rear section of the multi compartment manual side loading vehicle showing the rear doors and door attachment and latching detail.
Figures 9, 10:
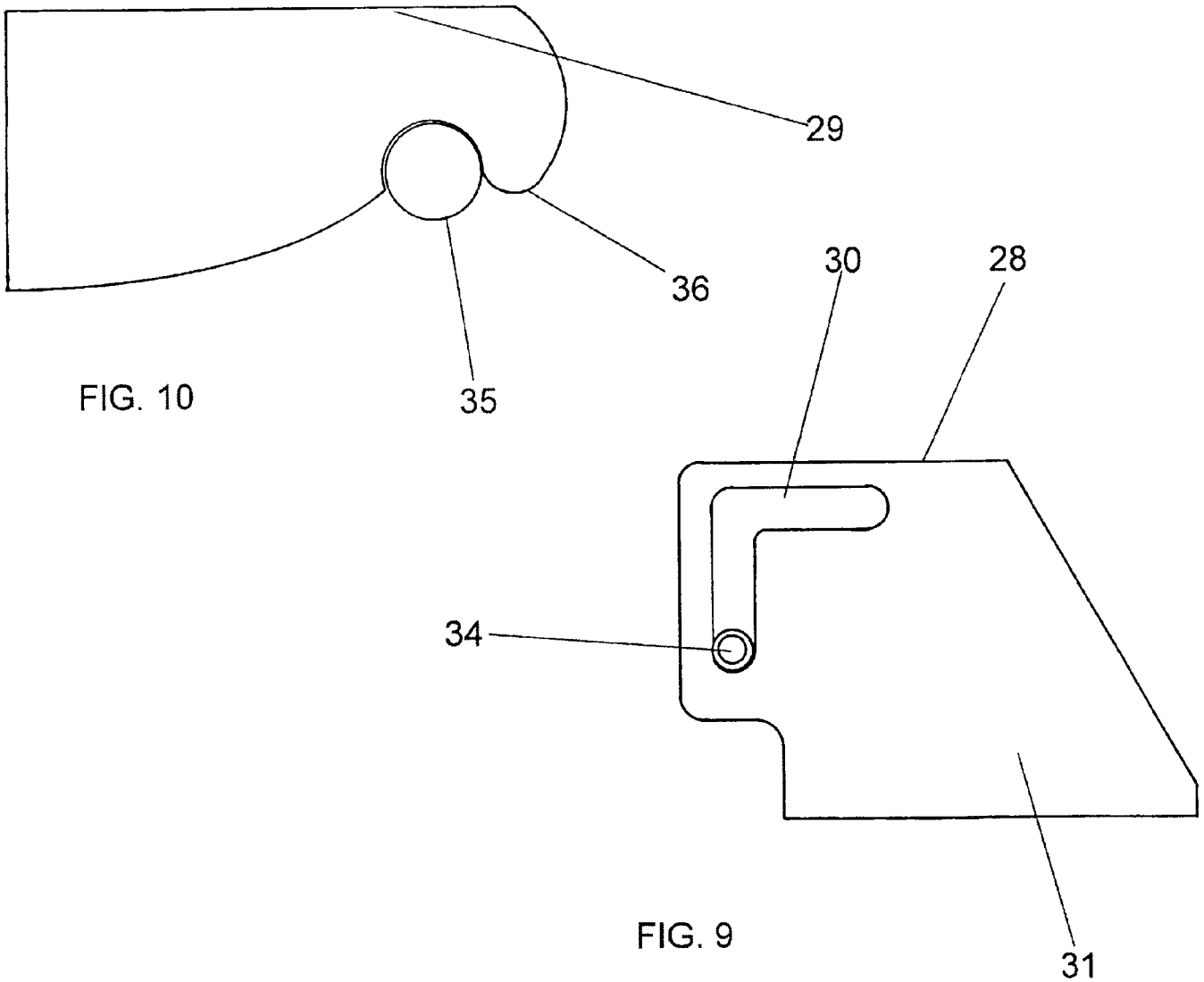
FIG. 9 is a detail drawing of the slot hinge assembly
FIG. 10 is a detail drawing of the latch hook assembly.

Referring now to FIGS. 8, 9 and 10, an improved hinge and latching assembly is shown for each of the rear doors. Hydraulic cylinders (27) are provided for opening and closing each door and are centrally located with reference to the midpoint of the door as shown in order to prevent asymmetric sagging of the door when opened. The central location of the hydraulic cylinders ensures that the door remains level with reference to the floor of the vehicle at all functional times. Each door is attached to the vehicle body at two hinge locations at the top by means of a slot flange pin hinge assembly (28) and (33) which operates in conjunction with the hook latches (29) at the bottom of each door to either unlock and open or close and latch the door in one directional movement of the hydraulic cylinder.

In particular, the slot flange pin hinge assembly consists of a metal flange (31) having an inverted L shaped slot (30) which flange is attached by means of welding, for example, to the vehicle body. Attached to the door and located adjacent and to the sides of the slotted flange are aligned spaced apart door hinge flanges (33). These spaced apart door hinge flanges (33) are provided with aligned holes for insertion of a pin (34). The door is hung to the vehicle by means of the pin (34) which is inserted through the aligned holes in the hinge flanges (33) and the slot (30) in the flange (31) such that the pin is now located in the slot (30) from which the door is now supported.

By this hinge means and arrangement, the door is able to both pivot with reference to the pin (34) and to move upwardly and rearwardly in the slot (30) by means of the movement of the pin (34) in the slot in response to a retraction of the hydraulic cylinder. As can be seen, the hook flange (29) ordinarily rests and is secured within the body of the vehicle by means of pin (35) which also represents the latched position for the door. The retraction of the hydraulic cylinder causes the pin (34) to move upwardly in the slot (30) which movement releases the hook flange (29) from its retaining pin (35) by lifting the door so as to permit the end (36) of the hook flange to vertically clear the pin (35). Thereafter further retraction of the hydraulic cylinder causes the pin (34) to move rearwardly and abut against the end of the slot and the door is able to pivot outwardly to open. Reversing the procedure by extending the hydraulic cylinder, closes and latches the door.

Although in the embodiments shown, the refuse vehicle body is divided into two equal compartments, this is not a requirement of the invention. The vehicle body may be divided into unequal compartments, in a ratio, for example, of 60/40 to accommodate different expected volumes of categories of refuse. As well, the refuse vehicle body may be divided into more than two compartments, as for example, three.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope of the thereof, it is to be understood that all matter herein set forth or shown in the accompanying drawings is to be interpreted as illustrative and not in a limiting sense.

What is claimed is:

1. A refuse vehicle body having an enclosed storage section for refuse and a hopper section adjacent said storage section for receiving refuse from a curbside collection point;

a) said storage section having a length, a height, a width, and at least one vertical dividing wall having a thickness along said length and height of said enclosure to thereby divide said storage section into at least two side by side compartments;

b) said vehicle body having a continuous floor along the length thereof, characterized in that the floor portion of the hopper section is lower than the floor portion of the storage section by a distance, wherein said floor portions are interconnected by means of an obliquely sloped floor portion;

c) said hopper section having a length and a width substantially equal to said width of said storage section, and a hydraulically operated pack blade having a substantially vertical front face for longitudinal movement along said floor portion of said hopper section, to thereby engage said refuse for upward transfer to said storage section by means of said sloped floor portion;

d) said hopper section having at least one vertical divider along said length of said hopper to thereby divide said hopper into at least two side by side hopper compartments complementarily aligned with said divided storage compartments; said divider having a length at least equal to said length of said hopper section, a height not greater than said distance, and two opposed ends, one of said ends being fixedly attached at right angles to said front face of said pack blade, said opposite end being free standing and defining a leading edge, said divider thereby able to slide together with said pack blade;

e) said sloped floor portion having vertically aligned slot means for slidably receiving said leading edge of said divider to thereby permit any portion of the length of said divider to pass therethrough and underneath said floor portion of said storage section.

2. The vehicle body as claimed in claim 1, wherein said hopper is enclosed by means of sidewalls and endwalls and wherein at least one of said sidewalls has an opening for refuse to pass therethrough.

3. The vehicle body as claimed in claim 2, wherein the width of said hopper section is additionally divided by means of a separator having a height attached between said endwalls immediately above said divider and vertically aligned therewith to permit sliding movement of said divider thereunder.

4. The vehicle body as claimed in claim 3, wherein said thickness of said dividing wall has a continuous inward taper towards a rear of the vehicle body.

5. The vehicle body as claimed in claim 4, wherein each said side-by-side storage compartment has a rear door hingedly attached from a top of said vehicle body; each said door having a width substantially equal to the width of said side-by-side storage compartment and having a latch; each said door having a hydraulic cylinder centrally positioned and pivotally attached at one end to said door and at the other end to the top of said vehicle body; each said door operable by means of said hydraulic cylinder to open from a latched position and close to a latched position.

6. The vehicle body as claimed in claim 5, wherein said hinge comprises a flange portion having an inverted L shaped slot formed therein; said latch comprising a flange having a hook portion formed at one end thereof; said enclosed storage section having a horizontal pin means formed therein and aligned with said latch; said latch retained within said enclosed storage section by means of engagement of said hook with said pin; movement of said hydraulic cylinder causing said door to move upwardly, disengaging said hook from said pin; further movement of said cylinder causing said door to pivot outwardly and rearwardly, thereby opening said door.

7. The vehicle body as claimed in claim 1, wherein each said side-by-side storage compartment has a rear door hingedly attached from the top of said vehicle body; each said door having a width substantially equal to the width of said-by-side storage compartment and having a latch; each said door having a hydraulic cylinder centrally positioned and pivotally attached at one end to said door and at the other end to the top of said vehicle body; each said door operable by means of said hydraulic cylinder to open from a latched position and close to a latched position.

8. The vehicle body as claimed in claim 7, wherein said hinge comprises a flange portion having an inverted L shaped slot formed therein; said latch comprising a flange having a hook portion formed at one end thereof; said enclosed storage section having a horizontal pin means formed therein and aligned with said latch; said latch retained within said enclosed storage section by means of engagement of said hook with said pin; movement of said hydraulic cylinder causing said door to move upwardly, disengaging said hook from said pin; further movement of said cylinder causing said door to pivot outwardly and rearwardly, thereby opening said door.

* * * * *